US008307497B2

(12) United States Patent
Chang et al.

(10) Patent No.: US 8,307,497 B2
(45) Date of Patent: Nov. 13, 2012

(54) SOFT-CLOSING DEVICE FOR A SLIDING DOOR

(75) Inventors: James Chang, Taichung (TW); Sung-Hui Lin, Taichung (TW)

(73) Assignee: Door & Window Hardware Co., Taichung (TW)

( * ) Notice: Subject to any disclaimer, the term of this patent is extended or adjusted under 35 U.S.C. 154(b) by 309 days.

(21) Appl. No.: 12/687,158

(22) Filed: Jan. 14, 2010

(65) Prior Publication Data

US 2011/0167588 A1 Jul. 14, 2011

(51) Int. Cl.
*E05F 1/00* (2006.01)

(52) U.S. Cl. ..... 16/71; 16/49; 16/82; 49/409

(58) Field of Classification Search ..... 16/71, 72, 16/82, 83, 84, 49, 51, 66, 70, 65, 96 R; 49/409, 49/414, 417

See application file for complete search history.

(56) References Cited

U.S. PATENT DOCUMENTS

| | | | | | |
|---|---|---|---|---|---|
| 526,461 | A * | 9/1894 | Rondell | 16/71 |
| 1,827,143 | A * | 10/1931 | Doyle | 16/83 |
| 2,083,450 | A * | 6/1937 | Kauffman et al. | 16/71 |
| 3,267,513 | A * | 8/1966 | Wartian | 16/84 |
| 3,278,979 | A * | 10/1966 | Clement | 16/72 |
| 4,003,102 | A * | 1/1977 | Hawks et al. | 16/72 |
| 4,004,372 | A * | 1/1977 | Beard et al. | 16/72 |
| 4,649,598 | A * | 3/1987 | Kinsey et al. | 16/84 |
| 4,819,295 | A * | 4/1989 | Kaftan | 16/72 |
| 5,131,188 | A * | 7/1992 | Hutchison et al. | 16/72 |
| 5,207,781 | A * | 5/1993 | Rock | 312/319.1 |
| 5,235,723 | A * | 8/1993 | Wallis | 16/71 |
| 5,251,402 | A * | 10/1993 | Richardson et al. | 16/49 |
| 5,659,999 | A * | 8/1997 | Benson | 16/72 |
| 6,848,759 | B2 * | 2/2005 | Doornbos et al. | 16/64 |
| 7,028,370 | B2 * | 4/2006 | Hoshide et al. | 16/96 R |
| 7,210,198 | B2 * | 5/2007 | Hoshide et al. | 16/96 R |
| 7,743,464 | B2 * | 6/2010 | Tomioka et al. | 16/49 |
| 2001/0008037 | A1 * | 7/2001 | Brustle | 16/71 |

FOREIGN PATENT DOCUMENTS

| | | | |
|---|---|---|---|
| JP | 05272271 | A * | 10/1993 |
| JP | 06272446 | A * | 9/1994 |
| JP | 06272447 | A * | 9/1994 |

* cited by examiner

*Primary Examiner* — Jeffrey O Brien
(74) *Attorney, Agent, or Firm* — Pearne & Gordon LLP

(57) ABSTRACT

A soft-closing device has a base, a cylinder, a slider and a resilient member. The base has a track channel and at least one guiding channel. The cylinder is mounted in the base and has a housing and an expansion rod. The slider is mounted slidably in the track channel, is connected pivotally to the expansion rod and has two holding arms, a positioning pin and a holding recess defined between the holding arms. The positioning pin is mounted slidably in the at least one guiding channel. The resilient member has two ends connected respectively with the base and the slider.

14 Claims, 6 Drawing Sheets

SOFT-CLOSING DEVICE FOR A SLIDING DOOR

BACKGROUND OF THE INVENTION

1. Field of the Invention

The present invention relates to a soft-closing device, and more particularly to a soft-closing device for a sliding door to provide a buffering effect and an auto-positioning effect to the sliding door.

2. Description of Related Art

A sliding door panel can be slid along a rail by power to close or open a path. However, the sliding door panel easily bumps against a doorframe or a wall due to a rapid moving speed of the door panel, and this easily causes the door panel or the doorframe being damaged. Therefore, a resilient buffering pad/block is mounted on the rail to keep the door panel from bumping against the doorframe or the wall when the door panel is moved to an original position, such as a completely opened or closed position. With the resilient buffering pad/block, the sliding door panel and the doorframe can be kept from being damaged.

However, the resilient buffering pad/block will provide a rebounding force to the door panel when the door panel abuts with the buffering pad/block. Thus, the door panel will be rebounded separately from the original position due to the rebounding force, so that the sliding door cannot be positioned at the desired position. Additionally, noise easily generates due to vibration of the sliding door occurred by the door panel bumping with the buffering pad/block.

SUMMARY OF THE INVENTION

The main objective of the invention is to provide a soft-closing device for a sliding door to provide a buffering effect and an auto-positioning effect to the sliding door. The soft-closing device comprises a base, a cylinder, a slider and a resilient member. The base has a chamber defined in the base, a track channel and at least one guiding channel. The track channel is defined in an outer surface of the base and communicates with the chamber. The at least one guiding channel is defined in the outer surface of the base and communicates with the chamber. Each guiding channel has an end provided with a positioning recess. The cylinder is mounted in the chamber of the base and comprises a housing and an expansion rod retractably mounted on the housing. The slider is mounted slidably in the chamber along the track channel, extends out from the base via the track channel, is connected pivotally to the expansion rod of the cylinder and comprises a body, two holding arms and a positioning pin. The holding arms are respectively formed on and protrude from the ends of the body to define a holding recess between the holding arms. The positioning pin is mounted on the body and is mounted slidably in the at least one guiding channel in the base. The resilient member is mounted in the chamber and has two ends connected respectively with the base and the slider.

DETAILED DESCRIPTION OF PREFERRED EMBODIMENT

Figure 1:
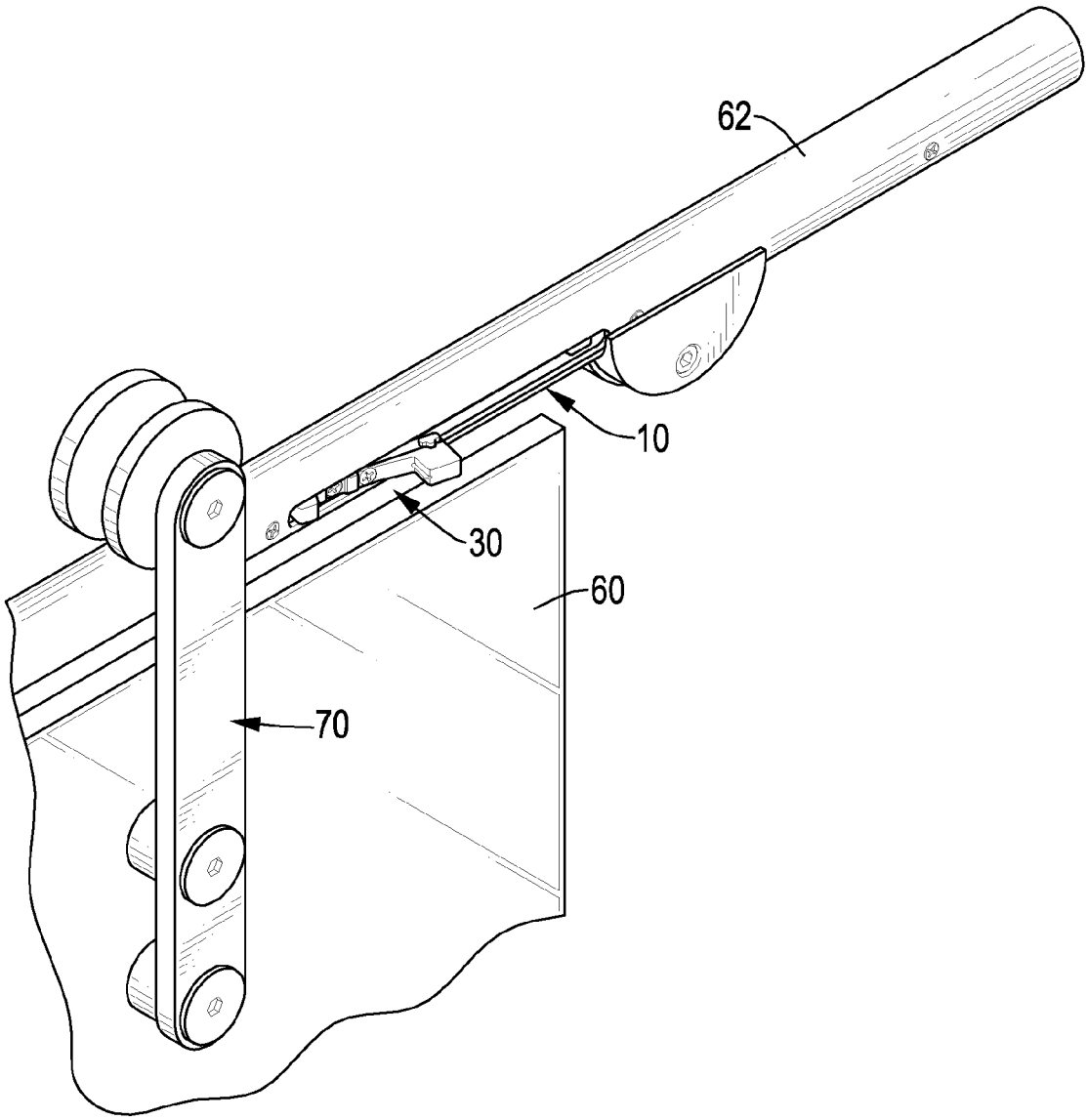
FIG. 1 is a perspective view of a soft-closing device in accordance with the present invention mounted on a rail for a sliding door.
Figure 2:
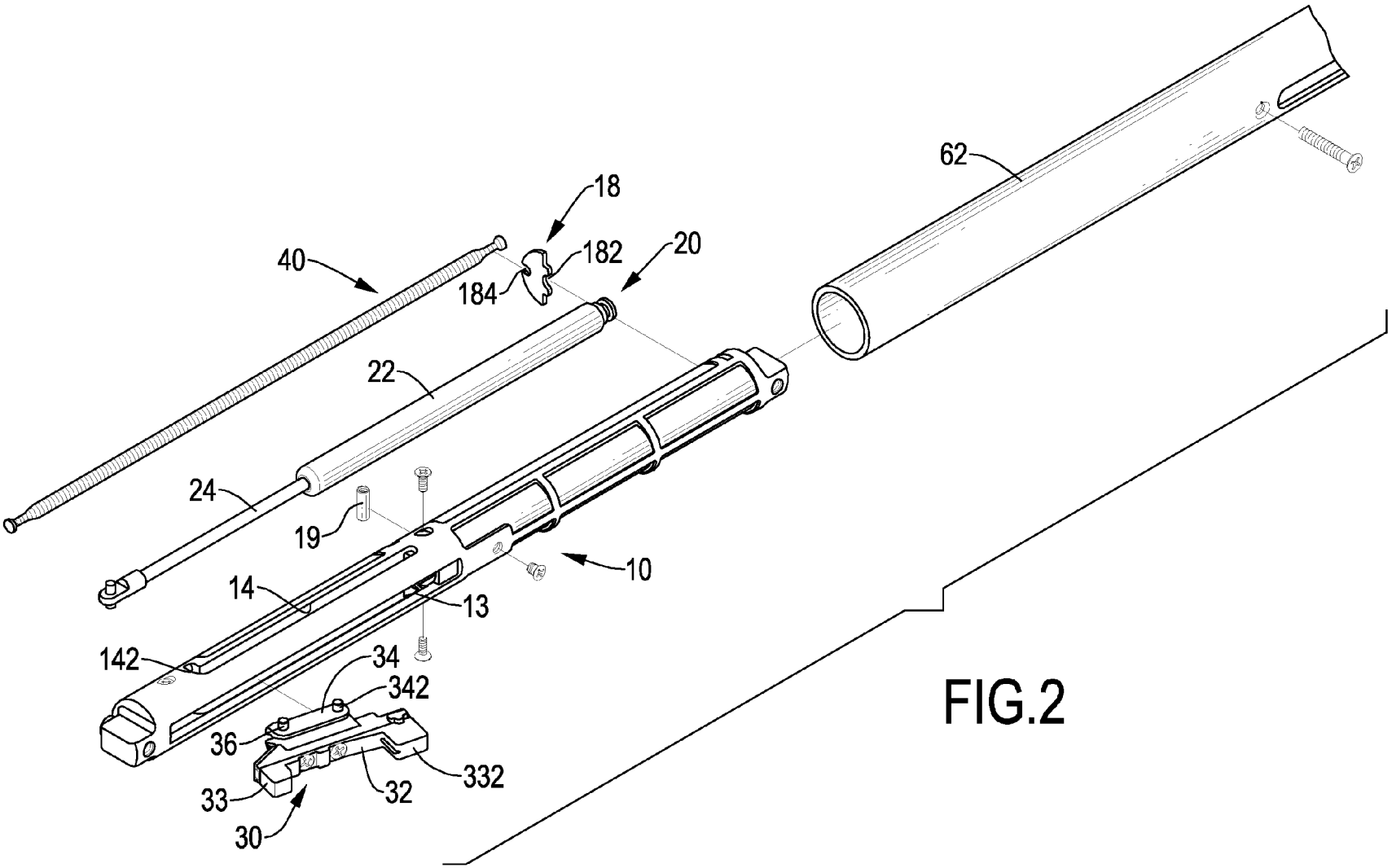
FIG. 2 is an exploded perspective view of the soft-closing device in FIG. 1.
Figure 3:
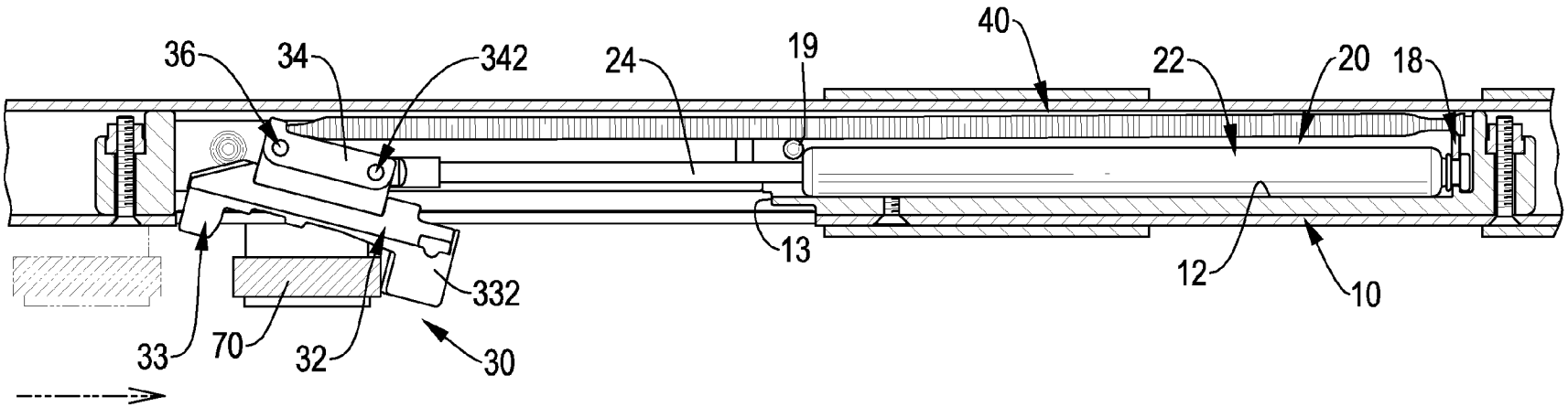
FIG. 3 is an operational top view in partial section of the soft-closing device in FIG. 1 showing a door panel being moved to an original position by the soft-closing device.

With reference to FIGS. 1 to 3, a soft-closing device for a sliding door in accordance with the present invention comprises a base (10), a cylinder (20), a slider (30) and a resilient member (40).

The base (10) may be elongated, is hollow and has a chamber (12), a track channel (13) and at least one guiding channel (14). The chamber (12) is defined in the base (10), may be defined in the outer surface of the body (10) and has an opening in the outer surface of the body (10). The track channel (13) is defined longitudinally in the outer surface of the base (10) and communicates with the chamber (12). The at least one guiding channel (14) is defined longitudinally in the outer surface of the base (10) and communicates with the chamber (12). Preferably, the base (10) has two guiding channels (14) aligning with each other. Each guiding channel (14) has an end provided with a positioning recess (142) being oblique to the guiding channel (14).

The cylinder (20) may be a hydraulic or pneumatic cylinder, is mounted in the chamber (12) and comprises a housing (22) and an expansion rod (24). The housing (22) contains hydraulic or pneumatic pressure inside. The expansion rod (24) is retractably mounted on and extends out from the housing (22). With the pressure in the housing (22), a damping and resistance force is applied to the expansion rod (24) when the expansion rod (24) is expanded from or retracted into the housing (22).

To hold the cylinder (20) in the opened chamber (12) of the base (10), the base (10) further has a securing tab (18) and multiple securing members (19) to hold the cylinder (20) in position. The securing tab (18) is inserted into the chamber (12) via the opening and has a securing recess (182) defined in a side edge of the securing tab (18) and holding one end of the housing (22) inside. The securing tab (18) further has an engaging recess (184) defined in a side edge of the securing tab (18). The securing members (19) are mounted through two sides of the opening of the chamber (12) to keep the cylinder (20) from escaping from the chamber (12).

The slider (30) is mounted slidably in the chamber (12) along the track channel (13), extends out from the base (10) via the track channel (13), is connected pivotally to an end of the expansion rod (24) and comprises a body (32), two holding arms (33,332), a positioning pin (36), a connection portion (34) and a guiding pin (342).

The holding arms (33,332) are respectively formed on and protrude from two ends of the body (32) to define a holding recess between the holding arms (33,332). The holding recess engages a connecting rod (70) that is mounted slidably on the rail (62) and connected securely to a door panel (60) of the sliding door. With the engagement between the holding recess and the connecting rod (70), the slider (30) can be moved with the door panel (60) while the door panel (60) is moving. The positioning pin (36) is mounted on the body (32) and is mounted slidably in the guiding channels (14).

The connection portion (34) is mounted on one side of the body (32) and has two ends. One end of the connection portion (34) is connected pivotally to the end of the expansion rod (24), and the positioning pin (36) is mounted on the other end of the connection portion (34). The guiding pin (342) is mounted on the connection portion (34) at the end that is connected pivotally to the end of the expansion rod (24) and mounted slidably in the guiding channels (14).

The resilient member (40) may be a spring, is mounted in the chamber (12) and has two ends connected respectively with the base (10) and the slider (30). One end of the resilient member (40) is connected to the connection portion (34) at the end on which the positioning pin (36) is mounted. One end of the resilient member (40) is connected to and engages the engaging recess (184).

Figure 4:
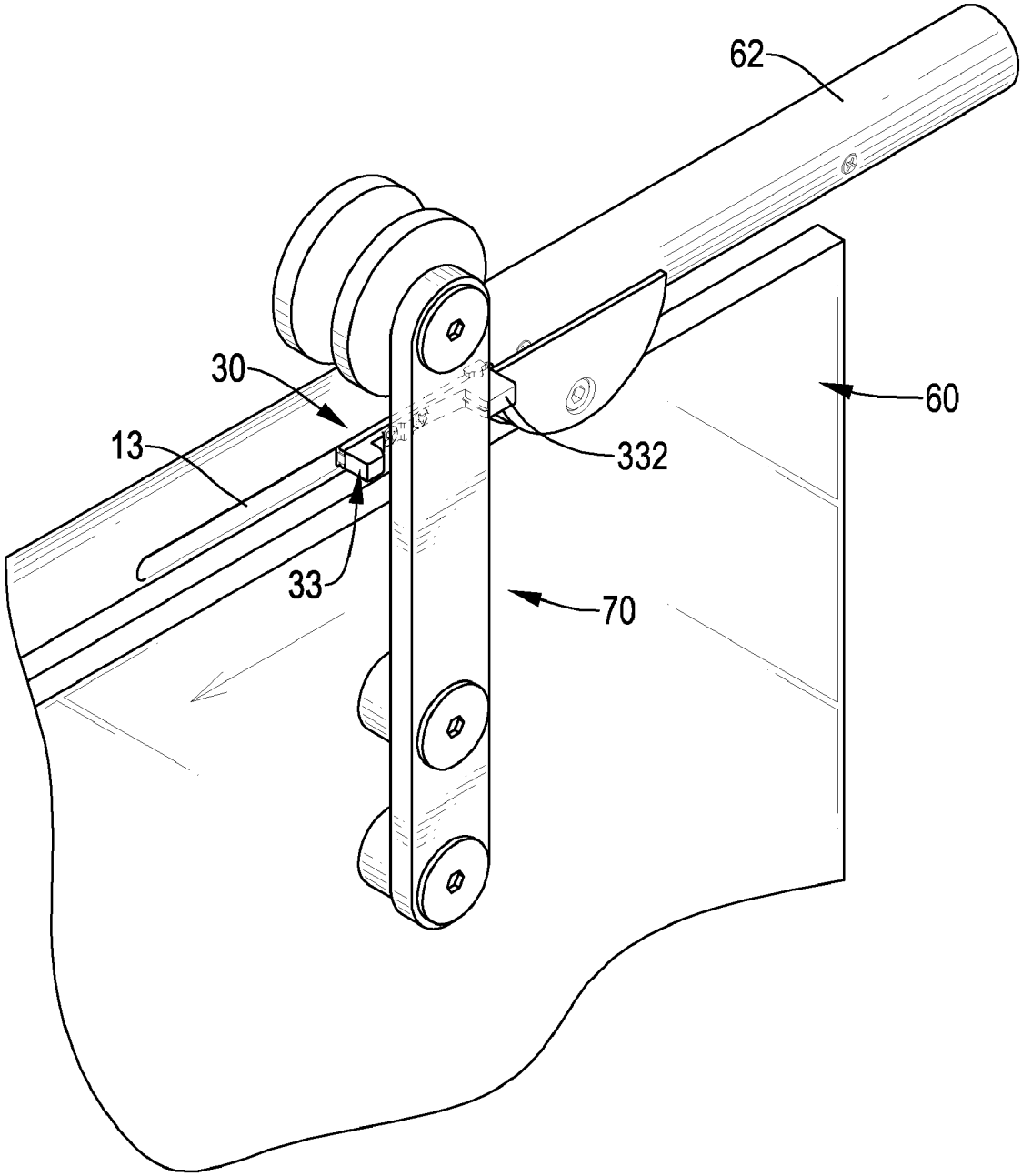
FIG. 4 is an operational perspective view of the soft-closing device in FIG. 1 showing the door panel being moved away from the original position.
Figure 5:
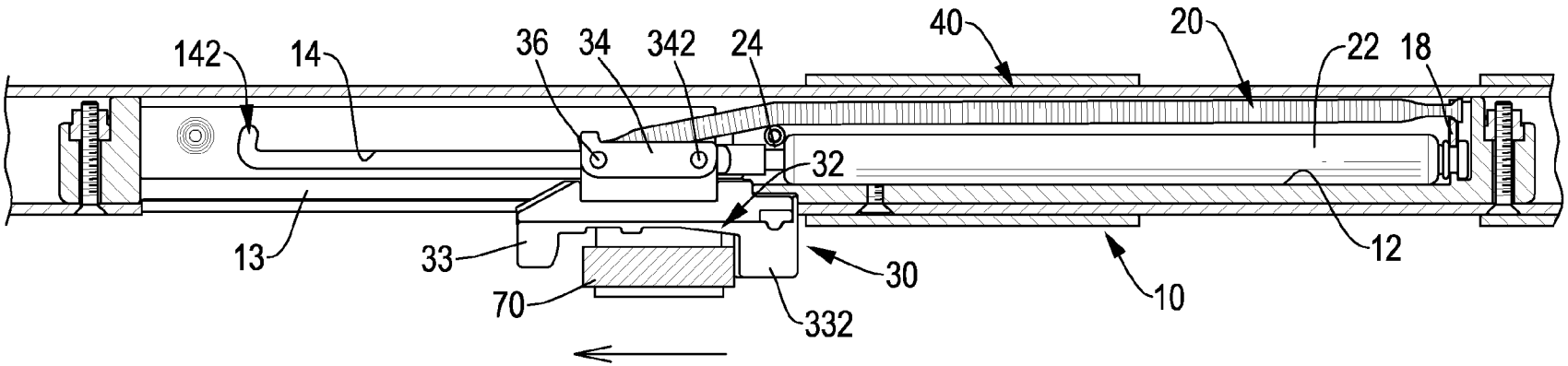
FIG. 5 is an operational top view in partial section of the soft-closing device in FIG. 4.
Figure 6:
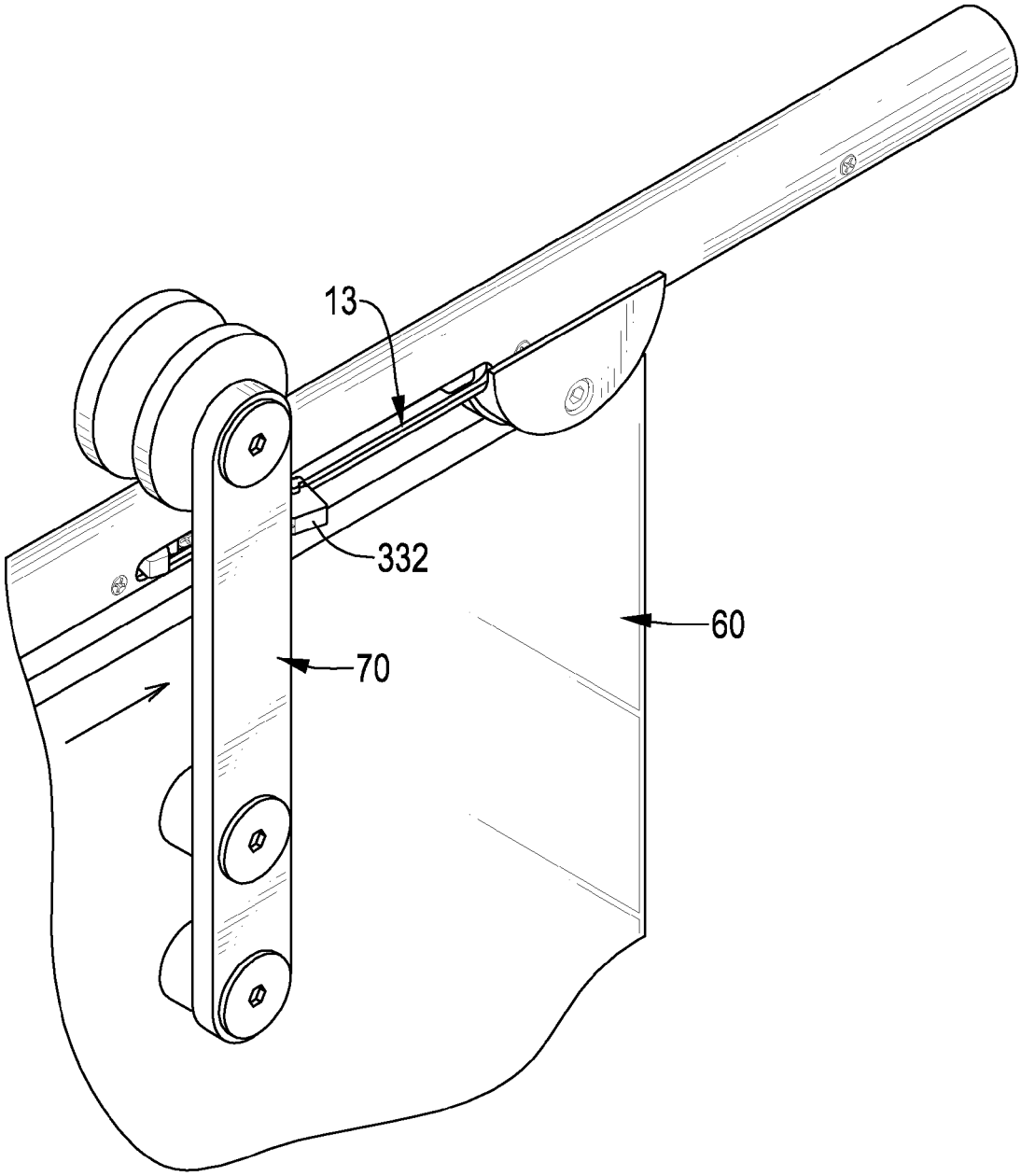
FIG. 6 is an operational perspective view of the soft-closing device in FIG. 3.

With reference to FIGS. 2, 4 and 5, when the door panel (60) is moved away from an original position, such as a completely opened or a closed position, the slider (30) will be moved along the track channel (13) due to the engagement between the holding recess and the connecting rod (70). With the movement of the slider (30), the positioning pin (36) and the guiding pin (342) move along the guiding channels (14), and the resilient member (40) is stretched and the expansion rod (24) is expended out from the housing (22). When the positioning pin (36) moves into the positioning recesses (142) in the ends of the guiding channels (14), the slider (30) will be pivoted relative to the expansion rod (24) and become oblique relative to the base (10). Accordingly, one of the holding arms (33) will move away from the connecting rod (70) and may retract into the chamber (12) to allow the connecting rod (70) disengaging from the holding recess. Consequently, the door panel (60) can keep moving away from the original position, and the length of the track channel (13) or the guiding channels (14) does not limit the travel of the door panel (60).

When the door panel (60) is moved to the original position by power, with reference to FIGS. 1 to 3 and 6, the connecting rod (70) will enter into the holding recess and push against the holding arm (332) extending outward from the track channel (13). Consequently, the slider (30) can be pivoted to engage the connecting rod (70) in the holding recess, such that the slider (30) can be moved along the track channel (13) with the door panel (60) to the original position. With the slider (30) moving toward the original position of the door panel (60), the expansion rod (24) can be retracted into the housing (22), and the hydraulic or pneumatic pressure in the housing (22) can provide the expansion rod (24) a damping and resistance force. Accordingly, the moving speeds of the door panel (60) and the slider (30) can be slowed down, and the door panel (60) can be kept from bumping against the doorframe or the wall at a high speed. Therefore, a buffering effect is provided to the door panel (60) to prevent the door panel (60), the doorframe or the wall from being damaged.

With the pressure in the cylinder (20), a rebounding force is prevented from being applied to the door panel (60), and vibration and noise can be avoided.

Moreover, during the movement of the door panel (60) toward the original position, the resilient member (40) can provide a recoil force to slider (30) to make the door panel (60) moving to and being positioned actually at the original position. Accordingly, an auto-positioning effect is provided to the door panel (60) by the recoil force of the resilient member (40). When the slider (30) is moved to retract the expansion rod (24) into the housing (22), the pressure in the cylinder (20) will provide a damping and resistance force against the slider (30), but the resilient member (40) provides a recoil force to the slider (30).

In practice, the forces provided by the cylinder (20) and the resilient member (40) can be arranged in reverse to that shown in the drawings. This means that the expansion rod (24) will be expanded from the housing (22) and the cylinder (20) provides a damping and resistance force to the slider (30) when the door panel (60) is moved toward the original position. At this time, the resilient member (40) is compressed.

What is claimed is:

1. A soft-closing device for a sliding door comprising: a base having a chamber defined in the base; a track channel defined in an outer surface of the base and communicating with the chamber; and at least one guiding channel defined in the outer surface of the base and communicating with the chamber, and each one of the at least one guiding channel having an end provided with a positioning recess; a linear damper mounted in the chamber of the base and comprising a housing; and an expansion rod retractably mounted on the housing; a slider mounted slidably in the chamber along the track channel, extending out from the base via the track channel, connected pivotally to an end of the expansion rod of the linear damper and comprising a body having two ends; two holding arms respectively formed on and protruding from the ends of the body to define a holding recess between the holding arms for receiving a portion of said sliding door; and a positioning pin mounted on the body and mounted slidably in the at least one guiding channel in the base; and a resilient member mounted in the chamber and having two ends connected respectively with the base and the slider, wherein the slider pivots from a first position in which the positioning pin is held in the positioning recess to a second position in which the positioning pin is released from the positioning recess.

2. The soft-closing device as claimed in claim 1, wherein the base is elongated and the chamber is defined in the outer surface of the base.

3. The soft-closing device as claimed in claim 2, wherein the base has two guiding channels aligning with each other.

4. The soft-closing device as claimed in claim 3, wherein the slider further has a connection portion having two ends; one end of the connection portion is connected pivotally to the expansion rod; and the positioning pin is mounted on the other end of the connection portion.

5. The soft-closing device as claimed in claim 4, wherein the slider further has a guiding pin mounted on the connection portion at the end that is connected pivotally to the expansion rod and mounted slidably in the guiding channels.

6. The soft-closing device as claimed in claim 5, wherein one end of the resilient member is connected to the connection portion at the end on which the positioning pin is mounted.

7. The soft-closing device as claimed in claim 6, wherein the base further has a securing tab and multiple securing members to hold the linear damper in position; and the securing tab has a securing recess defined in the securing tab and holding one end of the housing inside.

8. The soft-closing device as claimed in claim 7, wherein the securing tab further has an engaging recess defined in the securing tab; and one end of the resilient member is connected to and engages the engaging recess in the securing tab.

9. The soft-closing device as claimed in claim 1, wherein the base has two guiding channels aligning with each other.

10. The soft-closing device as claimed in claim 1, wherein the slider further has a guiding pin mounted on the slider at a position where the slider is connected pivotally to the expansion rod and mounted slidably in the at least one guiding channel in the base.

11. The soft-closing device as claimed in claim 10, wherein one end of the resilient member is connected to the slider at a position where the positioning pin is mounted.

12. The soft-closing device as claimed in claim 1, wherein the slider further has a connection portion having two ends; one end of the connection portion is connected pivotally to the expansion rod; and the positioning pin is mounted on the other end of the connection portion.

13. The soft-closing device as claimed in claim 1, wherein the base further has a securing tab and multiple securing members to hold the linear damper in position; and the securing tab has a securing recess defined in the securing tab and holding one end of the housing inside.

14. The soft-closing device as claimed in claim 13, wherein the securing tab further has an engaging recess defined in the securing tab; and one end of the resilient member is connected to and engages the engaging recess.

* * * * *